US005102477A

United States Patent [19]

Iwayama et al.

[11] Patent Number: 5,102,477

[45] Date of Patent: Apr. 7, 1992

[54] METHOD OF MANUFACTURING HIGH PERMEABILITY FE-NI SYSTEM ALLOY

[75] Inventors: Kenzo Iwayama, Kitakyushu; Tsunehiro Shimizu; Hidehiko Sumitomo, both of Hikari, all of Japan

[73] Assignee: Nippon Steel Corporation, Tokyo, Japan

[21] Appl. No.: 759,189

[22] Filed: Sep. 10, 1991

Related U.S. Application Data

[63] Continuation-in-part of Ser. No. 675,423, Mar. 26, 1991, abandoned.

[30] Foreign Application Priority Data

Mar. 30, 1990 [JP] Japan ..... 2-84326

[51] Int. Cl.[5] ..... C21D 8/12

[52] U.S. Cl. ..... 148/100; 148/120; 148/121; 148/2; 148/11.5 N

[58] Field of Search ..... 148/100, 12 A, 120, 148/121, 2, 11.5 N

[56] References Cited

U.S. PATENT DOCUMENTS 1,901,018 3/1933 Bieber et al. ..... 148/100
4,948,434 8/1990 Inoue et al. ..... 148/120

FOREIGN PATENT DOCUMENTS 0222611 10/1986 Japan ..... 148/2
430987 6/1935 United Kingdom ..... 148/12 D

*Primary Examiner*—H. Dean
*Assistant Examiner*—Sikyin Ip
*Attorney, Agent, or Firm*—Kenyon & Kenyon

[57] ABSTRACT

A method of producing Fe-Ni system high permeability alloy comprising the steps of obtaining cast steel sheet 0.3 to 7 mm thick by direct casting of a steel melt containing 35 to 85% by weight of nickel with the balance of iron and unavoidable impurities, forcibly cooling the sheet from solidification to 1200° C. at a cooling rate of at least 75° C./s, and cold-rolling the sheet at a reduction ratio of at least 20%.

5 Claims, 4 Drawing Sheets

METHOD OF MANUFACTURING HIGH PERMEABILITY FE-NI SYSTEM ALLOY

This application is a continuation-in-part of application Ser. No. 07/675,423 filed Mar. 26, 1991, abandoned.

BACKGROUND OF THE INVENTION

1. Field of the Invention

This invention relates to a method of manufacturing high permeability Fe-Ni system alloy, and in particular to a method of manufacturing high permeability Fe-Ni system alloy which omits the hot-rolling step.

2. Description of the Prior Art

High permeability Fe-Ni magnetic alloys are widely used as magnetic shielding materials. For example, such alloys are used to encase magnetic heads and as magnetic baffles for cassette tapes. Of such alloys, in particular, frequent use is made of high nickel permalloys (JIS-PC) and low nickel permalloys (JIS-PB) containing elements such as molybdenum, chromium and copper. While high nickel permalloy possesses high permeability and good resistance to corrosion, a drawback is that it is costly, containing as it does around 80% nickel, which is an expensive element, and the even more costly element, molybdenum. While low nickel permalloy is cheaper, having a nickel content of around 45%, and has a high saturation flux density of 15,000 G, it too has a drawback, which is that its alternating current permeability is much lower than that of high nickel permalloy.

Furthermore, permalloy is usually cast into ingots and hot-rolled one or more times, as required, at a high temperature of 1000° C. or more to obtain the cold-rolled material. However, during this high temperature heating the surface of the ingots or semiprocessed sheet is highly prone to grain boundary oxidation, so that there is a risk that fracturing may occur during the hot rolling. A further problem is that a special need to surface-grind the material increases the processing load and, as a consequence, produces a marked lowering of the yield. These problems, together with the sharp rises in the price of nickel over the past few years, have created a need for a fundamental reappraisal of permalloy manufacturing methods.

One way is to substitute cheaper elements for part of the nickel content. Such a method in which copper is used as the substitute element is disclosed by JP-A 62-5973/1987, JP-A 62-5974/1987, and JP-B Hei 1-53338/1989, among others, while JP-A Hei 1-252756/1989 uses chromium; in each case, however, the manufacturing process is a conventional one using hot rolling.

A method which omits the hot-rolling step is disclosed by JP-A Hei 1-290715/1989. The method of this disclosure, which focusses on grain orientation, one of the factors that determine magnetic properties, includes the steps of direct sheet-casting and cold-rolling of material with a high concentration of (100) grain texture. This promotes the development of a cubic grain structure which is advantageous in terms of magnetic properties, while at the same time the decreased number of processing steps reduces costs.

The present inventors also conducted extensive experiments relating to direct casting of steel sheet as a way of fundamentally improving the manufacturing process. These experiments showed that JP-A Hei 1-290715/1989 was inadequate in terms of ensuring the requisite magnetic properties.

Specifically, the premise of JP-A Hei 1-290715/1989 is that direct casting of sheet will result in a texture with a high concentration of (100) grains. However, the (100) face strength of actual slabs obtained thus was not very high; if anything, the grain texture was randomized. Moreover, it is known that in the case of permalloy PC, as the magnetic anisotropy constant is close to zero almost no effect can be expected, and in fact the magnetic properties tend to be inferior to those of hot-rolled materials.

JIS (Japanese Industrial Standards) divides Ni-Fe system permalloys into two classes: high nickel permalloys containing around 80% nickel and low nickel permalloys containing around 45% nickel. The high nickel permalloys normally include Mo, Cr, Cu and the like. Although the effect of including these components is a well known part of the history of permalloy development, they will be set forth here.

The first high permeability alloy of this type to be invented contained of about 80% Ni and the remainder of Fe. The high permeability of this component system was found to result from the alloy's extremely low constant of crystal magnetic anisotropy K and a constant of magnetostriction λ. It was later found that the addition of around 5% Mo to this alloy reduced its K and λ values to nearly zero, providing an alloy with almost unsurpassable permeability that came to be known as "Supermalloy." However, for obtaining this very high permeability it was necessary to restrict the cooling speed in final annealing (magnetic annealing) to within extremely narrow limits. This prevented the alloy from coming into general use.

It was next found that adding about 5% Cu to the Ni-Mo-Fe alloy made the cooling conditions less strict, and enabled the production of a high-permeability alloy appropriate for wide utilization (falling under the first JIS category mentioned above and known as JIS-PC).

The foregoing and other research regarding various alloying elements for inclusion in Fe-Ni system alloys was conducted between 25 and 35 years ago; it was also found that Cr and the like are effective for obtaining high permeability.

More recently, the extensive dissemination of high fidelity tape records and other audio equipment led to the use of permalloys in magnetic heads. In the early stage of this application, however, the heads were found to suffer heavy wear because of the softness of permalloys based on the composition systems known at the time. As a result of various attempts to overcome this problem, there were invented permalloys improved in anti-wear property by the addition of hardening elements such as Nb, Ti, Ta and V.

SUMMARY OF THE INVENTION

An object of the present invention is to provide a method of manufacturing high permeability alloy in which the steel sheet is directly cast to ensure the requisite permalloy magnetic properties.

Another object of the present invention is to provide a method of manufacturing high permeability alloy from rapidly-solidified slabs which does not include a hot-rolling step.

DETAILED DESCRIPTION OF THE INVENTION

Figure 1A:
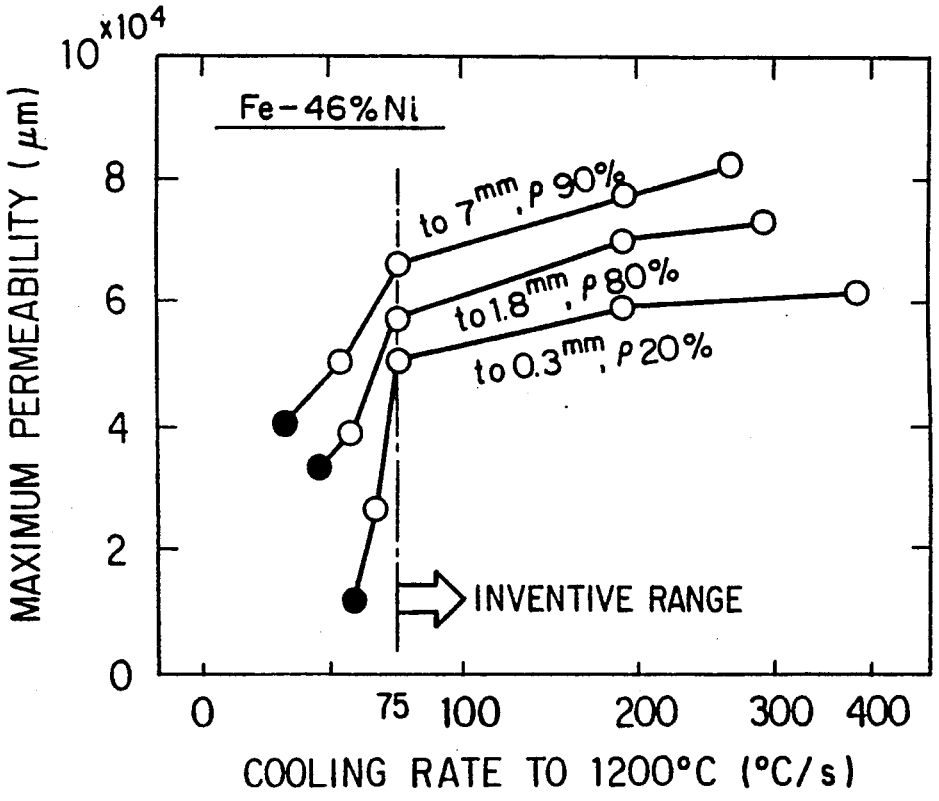
FIGS. 1A and 1B are graphs showing the relationship between magnetic properties and cooling rate to 1200° C. following casting.

From numerous studies they made to solve the problems of the prior art, the present inventors discovered the specific factors degrading the magnetic properties of steel sheet produced by the direct casting process and found a method of nullifying those factors, which enabled them to establish a method which ensured magnetic properties equal or superior to those of conventional hot-rolled materials.

It is known that the magnetic properties of a permalloy product are considerably degraded if the product grains are smaller than a specific size. Comparative studies of the grain structure of hot-rolled steel and directly cast steel, followed in each case by the same cold-rolling and annealing steps, showed that part of the material obtained by the casting process was constituted by small grains.

Experiments also showed that the size of grains in steel sheets produced by the direct casting process is determined by recrystallization rolling. Specifically, the grains of sheet obtained by direct casting are from about ten to one hundred times larger than the grains of hot-rolled sheet. It can therefore be assumed when such material is rolled, there will be a difference in the stress that the processing builds up within the grains.

As sheet produced by the conventional hot-rolling process has small grains, recrystallization is readily promoted by cold-rolling and the annealing that follows cold-rolling. Secondary recrystallization readily occurs in steel having a primary recrystallization grain structure if the steel is subjected to finish annealing at 1100° C. for two hours, for example. It therefore can be assumed that finished steel that has a large grain structure will have good magnetic properties.

Because steel produced by the direct casting process has large grains, uniform stress is not readily introduced during the cold-rolling process, and secondary recrystallization does not readily develop in the annealing that follows. It is thus considered that the finished product readily tends to be constituted of small grains.

The present invention enables these defects to be overcome, and comprises the steps of preparing a melt containing 35 to 85% by weight of nickel and known Fe-Ni system magnetic material alloying elements, with the balance of iron and unavoidable impurities; rapidly solidifying the melt by continuously casting it onto a moving cooling body having one or two cooling surfaces to thereby obtain cast sheet slabs 0.3 to 7 mm thick; using a gas-and liquid spray to forcibly cool the solidified sheet slabs coming off the cooling body to a temperature of 1200° C. at a cooling rate of 75° C./s; and cold-rolling the slabs at a reduction rate of 20%.

The inventors found a way of eliminating the factors that degrade magnetic properties by controlling the coiling temperature of the cast steel. This involves rapidly cooling the sheet to 1200° C. or below and coiling it at a temperature of 850° C. or below, as required.

While JP-A Hei 1-290715/1989 teaches directly cold-rolling the cast sheet, in accordance with the present invention, prior to the cold rolling the cast sheet is subjected to heat treatment at 700°-1200° C., as required, for a period of substantially zero or more seconds. Also if necessary, any surface scaling is removed prior to the heating, by pickling, or by bombarding ("blasting") the surface with hard particles, or by grinding.

Although employing a direct sheet casting process, compared with JP-A Hei 1-290715/1989, which uses a cold-rolling reduction ratio of at least 50%, the present invention uses a lower reduction ratio of 20% or more and makes it possible to ensure the requisite magnetic properties, and it also provides the major advantage of expanding the usable thickness range of the finished product.

The present invention also proposes the step of blasting the cast sheet surface with hard particles prior to the heat treatment. The particles used for this high-speed blasting may be iron or sand or the like. Either grit (edged, irregularly-shaped particles) or shot (roundish particles) may be used. The particles are projected at the sheet by a centrifugal arrangement or from the nozzle of a high-speed compressed-air means. One or both surfaces may be blast-cleaned; preferably both surfaces will be subjected to this blast-cleaning to avoid curling.

Although large shot increases the depth of the processing, it leaves larger marks and increases the surface roughness. In general, particles should be used which range in size from a fraction of the sheet thickness to several times the thickness. The amount of time the blasting lasts will depend on the type of steel, the surface roughness, and the purpose, but should be sufficient to ensure that substantially all of the surface is processed so as to ensure at least a surface layer of fine recrystallization grains from the subsequent annealing.

Using the above means ensures that the magnetic properties of permalloy obtained by direct casting are at least equal to those of steel produced by a conventional process which includes hot rolling.

The reasons for the component limitations according to this invention will now be described. Nickel is the basic constituent of the inventive alloy. A nickel content that is less than 35% or over 85% degrades the material's original "soft" magnetic properties, so the nickel content is set at 35 to 85%. This is the case with PB, PC, PCS, PE, PD and others specified by JIS C2531.

The same alloying elements as used in conventional methods can be used for the same purposes in the method according to this invention, with good effect and with no adverse influence on the intrinsic advantages of the invention. Specifically, for improving and stabilizing magnetic properties there can be added to the alloy not more than 7% molybdenum, not more than 20% copper and not more than 20% chromium, and for improving wear resistance there can be added thereto not more than 0.1% niobium, not more than 0.1% titanium, not more than 0.1% tantalum, and not more than 0.1% vanadium. In addition, small quantities of aluminum, silicon, magnesium, manganese, and carbon are usually included for deoxidation and other purposes. It is also well-known that to ensure the magnetic properties of the finished product, the lower the content the better in the case of such elements as carbon, oxygen, sulfur and nitrogen. The molten steel of this invention may use the same constituent elements as those used in Fe-Ni system magnetic steel produced by the conventional hot-rolling process.

In this invention the cold-rolling sheet material is produced by a direct casting process. Any double-roll, single-roll or belt system may be applied which enables the melt to be rapidly solidified by being continuously cast onto a moving cooling body having one or two cooling surfaces, as described above.

A cast sheet thickness of 0.3 to 7 mm is specified as a thickness exceeding 7 mm reduces the advantages gained by omitting the hot-rolling process, while it is difficult to obtain stable sheet thickness if the thickness is less than 0.3 mm. It is necessary to promptly cool the solidified cast sheet coming off the cooling body to a temperature of 1200° C. at a cooling rate of 75° C./s. This cooling is provided by spraying the surface of the cast steel with a liquid, such as water or brine, or a mixture of a liquid and a gas, such as air.

Figure 1B:
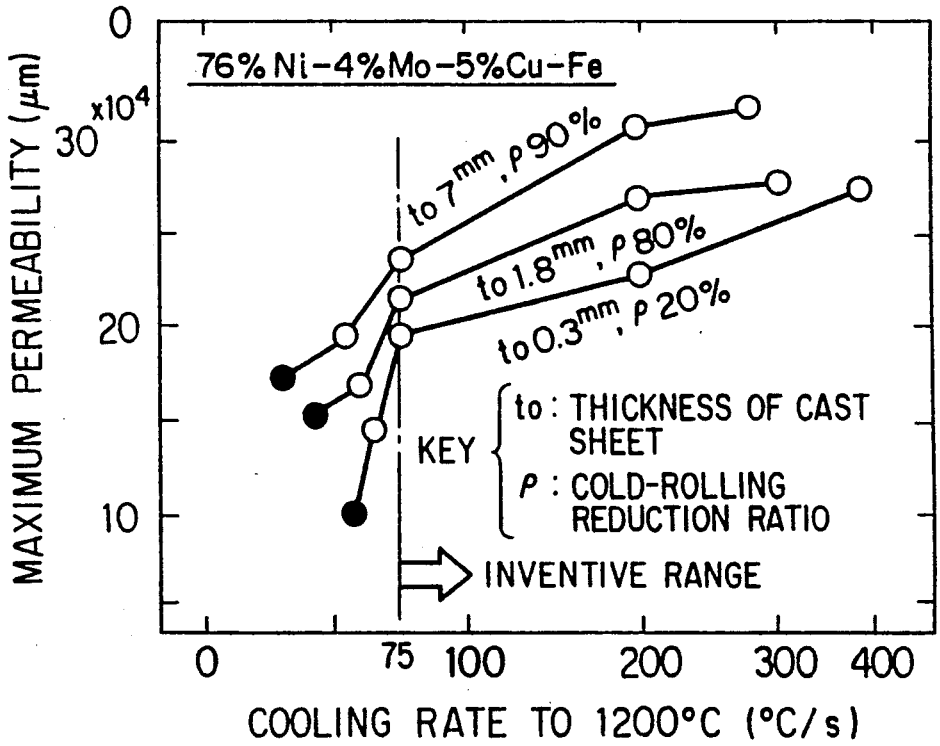

FIG. 1 shows the maximum permeability (μm) of a product steel obtained by cold-rolling sheet obtained by directly casting Fe-46% Ni steel and 76% Ni-4% Mo-5% Cu-Fe steel, followed by final annealing for two hours in a hydrogen atmosphere. Cooling to 1200° C. was effected using each type of spray. From FIG. 1 it can be seen that following the casting by forcibly cooling to 1200° C. at a minimum rate of 75° C./s resulted in markedly better magnetic properties than those obtained using conventional air cooling (indicated in FIG. 1 by ".") or a cooling rate lower than 75° C./s.

The cast sheet obtained in accordance with the present invention was subjected to cold-rolling at a minimum reduction rate of 20%. The examples plotted in FIG. 1 were cold-rolled at this reduction rate of at least 20%. A reduction rate lower than 20% makes it difficult to obtain the requisite magnetic properties.

Commercially produced permalloy sheet is formed into coils, and it was found that a high coiling temperature degrades the final magnetic properties. It was found that this problem could be solved by an additional forced cooling step to cool the sheet from 1200° C. to 850° C. as required and performing the coiling at or below 850° C.

Figure 2A:
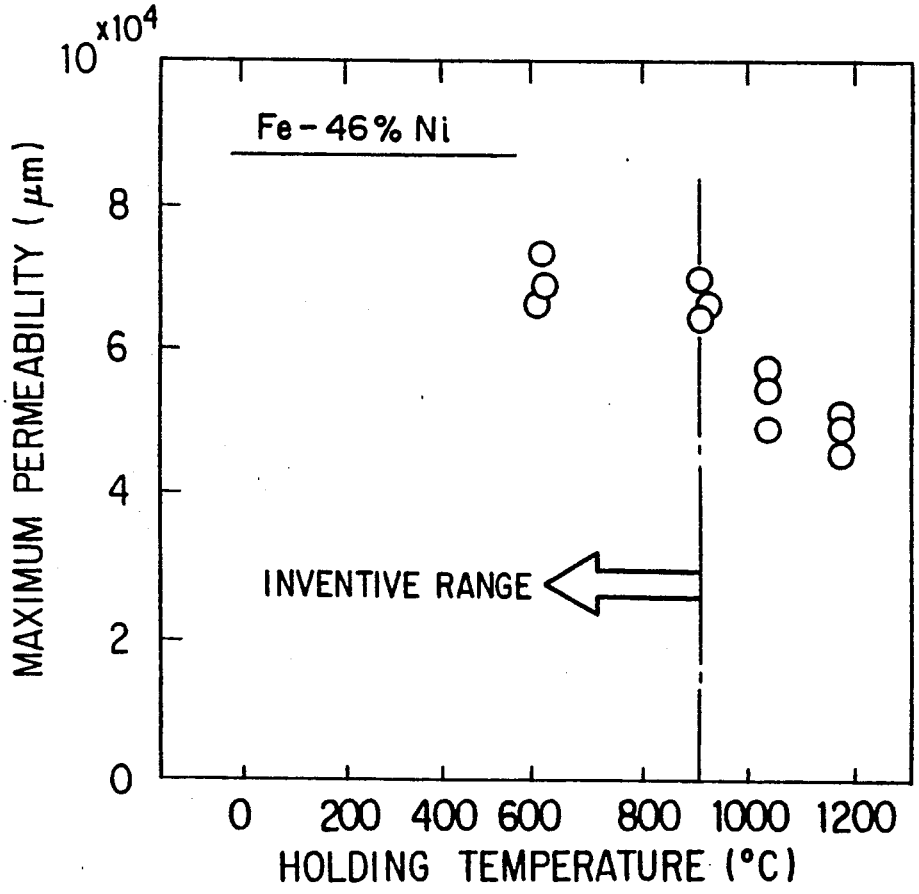
FIGS. 2A and 2B are graphs showing changes in magnetic properties when slabs are held at a prescribed temperature for two hours.
Figure 2B:
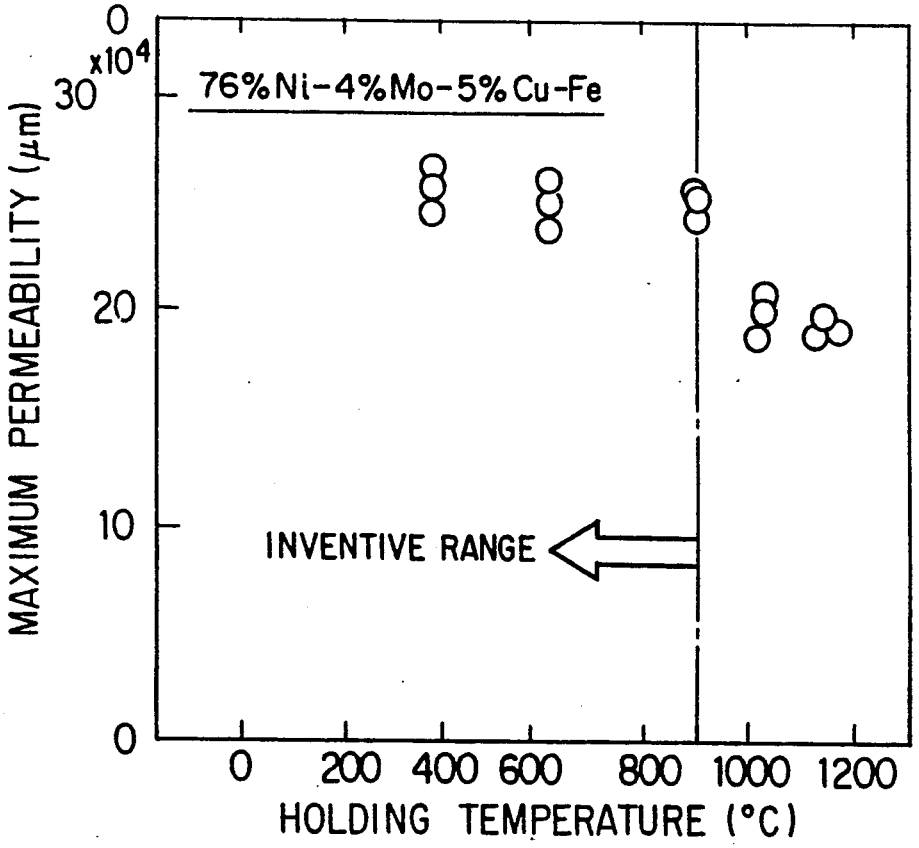

FIG. 2 is a graph showing maximum permeability (μm) of the steel maintained at temperatures corresponding to coiling temperatures. That is, cast sheets of Fe-46% Ni steel and 76% Ni-4% Mo-5% Cu-Fe steel with a thickness of 0.9 to 2.5 mm were first cooled to 1200° C. at a rate of 200° C./s and were then spray-cooled below 1200° C. The coiling temperature state was then simulated and the sheets maintained for two hours in a furnace at each of the set temperatures. Following this, the sheets were air-cooled and cold-rolled at a reduction ratio ranging from 40 to 90%, and were then subjected to two hours of heat treatment at 1100° C. in a hydrogen atmosphere.

As can be seen from FIG. 2, a coiling temperature higher than 850° C. caused a deterioration in the magnetic properties, good magnetic properties were retained with a coiling temperature of around 400° C., 600° C. and 850° C. Therefore, the temperature should be no higher than 850° C.

In practice, to a greater or lesser extent the surface of the sheet that is to be rolled is uneven, and it was found that cold-rolling, particularly at a low reduction ratio, tended to result in an inferior finished shape. This problem is greatly alleviated by subjecting the steel to a heat treatment at 700° to 1200° C. for zero or more seconds, prior to the cold-rolling.

When non-annealed cast sheet was cold-rolled at a reduction rate of 40% to form a sample 1 mm thick, 80 mm wide and 300 mm long, when the sample was placed on a flat surface it was found that edge waviness was as much as 20 mm. When an identical sample was cold-rolled after being maintained in a furnace at 1000° C. for 30 seconds, the waviness was reduced to 5 mm. Almost no waviness was observed when the heat treatment was preceded by sand-blasting both surfaces. The effect of the heat treatment is reduced when the temperature lower than 700° C. is used, while heating to a temperature over 1200° C. is uneconomical. Hence, a range of 700° to 1200° C. was set.

Thus, Fe-Ni system high-permeability alloy sheet produced by the method of this invention is superior to sheet produced by the prior art, in terms of both magnetic properties and cold-rolled shape. In addition, using cast steel sheet formed by rapid solidification, thereby omitting the hot-rolling step, gives the process wide practical applicability.

EXAMPLE 1

Steels having the Fe-Ni alloy constituents listed in Table 1 were melted in a 7.5 kg electric furnace and directly cast, using a pair of rolls each 400 mm in diameter, to form continuously cast steel sheets 0.7 to 4 mm thick. The thus-cast steels were cooled down to 1200° C. at a cooling rate of 50° to 250° C./s by controlling the intensity of a mixed air-water spray directed onto the two surfaces of the sheets from directly below the rolls. After grinding off surface scaling, the steel was cold-rolled at a reduction ratio of 40 to 98%.

Pieces of the sheets were sheared to form samples for measuring magnetic properties in accordance with the JIS procedure. An annealing separator of magnesium was applied between the sample sheets, which were then subjected to final annealing for two hours at 1100° C. in a hydrogen stream with a dew point of −60° C. Table 1 shows the maximum permeability values (μm) of the samples together with the rate at which cooling down to 1200° C. was effected. PD (symbols A, B, C), PB (D, E, F), PE (G, H, I) PC (J, K, L) and PCS (M, N, 0) were each cooled down to 1200° C. at a cooling rate of 75° C./s in accordance with the method of this invention and each exhibited good magnetic properties.

TABLE 1

| Symbol | Steel components (wt. %) Ni | Mo | Cu | Fe | Cooling rate to 1200° C. (°C./s) | Reduction ratio (%) | Maximum permeability (μm) |
|---|---|---|---|---|---|---|---|
| A | 36.5 | — | — | Balance | 50 | 70 | 12,000 |
| Ⓑ | | | | | 75 | | 26,000 |
| Ⓒ | | | | | 200 | | 29,000 |
| D | 46 | — | — | Balance | 50 | 65 | 43,000 |
| Ⓔ | | | | | 75 | | 79,000 |
| Ⓕ | | | | | 250 | | 81,000 |
| G | 55 | — | — | Balance | 50 | 98 | 55,000 |
| Ⓗ | | | | | 75 | | 112,000 |
| Ⓘ | | | | | 250 | | 125,000 |
| J | 76.8 | 3.90 | 5.02 | Balance | 50 | 70 | 133,000 |
| Ⓚ | | | | | 75 | | 282,000 |
| Ⓛ | | | | | 200 | | 304,000 |
| M | 80.1 | 5.00 | — | Balance | 50 | 40 | 157,000 |
| Ⓝ | | | | | 75 | | 354,000 |
| Ⓞ | | | | | 250 | | 328,000 |

Note: Circled symbols indicate inventive samples.

EXAMPLE 2

The PC component samples of Example 1 (symbols J, K, and L) were melted in a 600 kg electric furnace and were then formed into 2.0 mm coils A to G by means of a pair of rolls each 400 mm in diameter. After cooling down to 1200° C. at a cooling rate of 200° C./s by the same technique used in Example 1, water-cooling was applied as required to achieve each coiling temperature. Part of sample A, which was not coiled, was cut off and air-cooled steel was used.

Coils A to E were cold-rolled at a reduction ratio of 75%. Coil F was heated at 1100° C. for 30 seconds before being cold-rolled. Both surfaces of coil G were subjected to blasting by steel grit with a particle size of 0.5 to 1.0 mm to form a processed layer over the entire surface area, and coil G was then given the same heat treatment as coil F, and cold-rolled.

Samples were then cut from each coil to measure the magnetic properties, given a surface coating of magnesium, subjected to normalization for two hours at 1100° C. in a hydrogen stream with a dew point of −60° C. and cooled to room temperature at a rate of 80° C. The magnetic properties were then measured and are listed in Table 2, together with the coiling temperature and the cold-rolled shape rank.

Shapes are ranked as good(◎), acceptable (○), or poor (Δ), using the method mentioned. The magnetic properties of samples A to E listed in Table 2 show clearly the effectiveness of coiling at or below a temperature of 850° C. Also, the addition of heat treatment (F) and surface processing prior to the heat treatment (G) produce a major improvement in the shape of the cold-rolled sheet.

TABLE 2

| Symbol | Coiling temperature (°C.) | Cold-rolled shape | Maximum permeability (μm) |
|---|---|---|---|
| A | (Air-cooled without coiling) | Δ | 291,000 |
| B | 1100 | Δ | 213,000 |
| C | 900 | Δ | 267,000 |
| D | 850 | Δ | 290,000 |
| E | 400 | Δ | 295,000 |
| F | 750 | | 296,000 |
| G | 750 | ◎ | 295,000 |

EXAMPLE 3

Steels having a composition consisting of 45.6% nickel, 0.24% silicon, 0.59% manganese, 0.11% chromium, 0.006% carbon and 0.0030% sulfur as the basic components, with the balance being iron and unavoidable impurities, were directly cast into sheet slabs 1.5 to 7 mm thick, and the steel sheets thus obtained were cooled down to 1200° C. at a cooling rate of 30° to 250° C./s by controlling the intensity of an air-water spray directed onto the two surfaces of the sheets from directing below the rolls. The sheets were then cold-rolled at a reduction ratio ranging from 20 to 92% and subjected to the same annealing procedure and measurement of magnetic properties used in Example 1. The results are listed in Table 3.

TABLE 3

| Symbol | Cooling rate to 1200° C. (°C./s) | Thickness of cast sheet (mm) | Reduction ratio (%) | Maximum permeability (μm) |
|---|---|---|---|---|
| A | 30 | 7 | 50 | 8,000 |
| Ⓑ | 170 | 6.8 | 92 | 75,000 |

TABLE 3-continued

| Symbol | Cooling rate to 1200° C. (°C./s) | Thickness of cast sheet (mm) | Reduction ratio (%) | Maximum permeability (μm) |
|---|---|---|---|---|
| C | 30 | 2.5 | 80 | 43,000 |
| Ⓓ | 200 | 2.8 | 75 | 85,000 |
| E | 50 | 1.5 | 50 | 32,000 |
| Ⓕ | 250 | 1.6 | 20 | 81,000 |

Note: Circled symbols indicate inventive samples.

The inventive steels B, D and F show better magnetic properties than those of the conventionally prepared samples A, C and E.

EXAMPLE 4

Steel having the same composition as the steels of Example 3 were cast into sheets 0.3 to 0.7 mm thick, using a pair of rolls each 70 mm in diameter. After the casting the steel was cooled to 1200° C. at or above a rate of 300° C./s. The sheets were then cold-rolled at the various reduction ratios and subjected to the same annealing procedure and measurement of magnetic properties used in Example 1. The results are listed in Table 4.

TABLE 4

| Symbol | Thickness of cast sheet (mm) | Reduction ratio (%) | Maximum permeability (μm) |
|---|---|---|---|
| A | 0.31 | 18 | 9,500 |
| Ⓑ | 0.30 | 30 | 74,000 |
| C | 0.56 | 15 | 17,000 |
| Ⓓ | 0.55 | 25 | 72,000 |
| E | 0.68 | 17 | 28,000 |
| Ⓕ | 0.70 | 50 | 78,000 |

Note: Circled symbols indicate inventive samples.

The inventive steels B, D and F show better magnetic properties than those of the samples A, C and E which were cold-rolled at a reduction ratio outside the specified limits.

What is claimed is:

1. A method of producing Fe-Ni system high permeability alloy, comprising the step of:

obtaining cast alloy by preparing a melt comprising 35 to 85% by weight of nickel with the balance being iron and unavoidable impurities, and rapidly solidifying the melt by continuously casting the melt onto a moving cooling body having one or two cooling surfaces to thereby obtain cast sheet 0.3 to 7 mm thick;

using a liquid or gas and liquid spray to cool the solidified cast sheet coming from the cooling body to a temperature of 1200° C. at a cooling rate of at least 75° C./S;

cold-rolling the cooled cast sheet at a reduction rate of at least 20%.

2. A method according to claim 1 wherein the melt further contains at least one element selected from the group consisting of:

7% or less Mo,
20% or less Cu,
20% or less Cr,
0.1% or less Nb,
0.1% or less Ti,
0.1% or less Ta, and
0.1% or less V

3. The method according to claim 1 wherein prior to cold rolling, the cooled solidified cast sheet is further rapidly cooled to below 1200° C. and coiled at a coiling temperature of 850° C. or lower.

4. The method according to claim 1 wherein the cast sheet is subjected to heat treatment at 700° to 1200° C.

5. The method according to claim 4 wherein surface scale on the cast steel is removed prior to the heat treatment of the cast steel.

* * * * *